US007513211B1

(12) United States Patent
Farb et al.

(10) Patent No.: US 7,513,211 B1
(45) Date of Patent: Apr. 7, 2009

(54) CRUISER SPLIT SEATING SYSTEM AND LOCKING CONVERSION

(75) Inventors: Steve Farb, Arlington, WA (US); Steve Somogy, Arlington, WA (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/828,001

(22) Filed: Jul. 25, 2007

Related U.S. Application Data

(60) Provisional application No. 60/820,402, filed on Jul. 26, 2006.

(51) Int. Cl.
*B63B 17/00* (2006.01)

(52) U.S. Cl. ..... 114/363

(58) Field of Classification Search ..... 114/363
See application file for complete search history.

(56) References Cited

U.S. PATENT DOCUMENTS 3,052,896 A 9/1962 Beach
3,379,471 A 4/1968 Dalziel
3,394,417 A 7/1968 O'Link
3,635,521 A 1/1972 Shivvers
3,884,522 A 5/1975 Arima et al.
4,526,421 A * 7/1985 Brennan et al. ..... 297/232
4,637,081 A 1/1987 Clark
4,854,261 A 8/1989 Goldsmith
5,799,605 A 9/1998 Huse
6,883,458 B2 4/2005 Huse
6,945,190 B1 * 9/2005 Frandsen ..... 114/363

* cited by examiner

*Primary Examiner*—Stephen Avila
(74) *Attorney, Agent, or Firm*—Malin Haley DiMaggio Bowen & Lhota, P.A.

(57) ABSTRACT

A seat assembly for use in boats. The seat assembly includes a pair of seating platforms with a reclining seat back and a sliding seat bottom. A removable section is inserted between the seat bottom and the seat back to create a long recliner. A central panel and pad are set between the seating platforms to create a large surface area sunpad. The seating platforms are hollow to allow for storage of the central panels and pads and the removable sections.

8 Claims, 11 Drawing Sheets

CRUISER SPLIT SEATING SYSTEM AND LOCKING CONVERSION

This application is a continuation of, and claims the benefit of priority to, Applicants previously filed provisional patent application Ser. No. 60/820,402 filed on Jul. 26, 2006.

BACKGROUND OF THE INVENTION

1. Field of the Invention

The present invention generally relates to seats on a boat, and more particularly, a seat assembly on a boat which have an upright state, a reclined state, the ability to extend the length of the seat during the reclined state, the ability to increase reclined surface area during the reclined state by adding panels between the seats on a boat, and the ability to store all additional pieces within each seat on a boat.

2. Description of Related Art

Boat designs have included a variety of seating arrangements and designs for the user. Specifically, there are many different designs for seats located within a boat, especially for open topped boats commonly used for day trips of limited duration. In addition, these seats provide the user with a variety of positions in which to sit. Due to the limited space within a boat, these different positions must be operable within small parameters. Often modern boats have seats which can change from providing an upright position to providing a reclining position, but the user's legs are left without support. Other designs provide the ability to recline, but with cumbersome parts and uncomfortable ergonomics. Further, users of boats often desire to stretch out or relax in comfort but because of the limited space provided on the seat of a boat, this is either impossible or uncomfortable.

Although prior designs have sought to improve the structure, operation, and utility of seats on marine vehicles, existing designs have failed to adequately address the desire for ease of use, storage, safety, practical size, comfort, and the potential for use by multiple users at one time.

The prior art reveals a number of attempts directed toward improving seats on marine vehicles, including changing position between upright and reclined states. For example, U.S. Pat. No. 6,883,458 issued to Huse discloses a FOLD-DOWN SEAT CONSTRUCTION. Huse discloses a boat seat assembly in which two seats are created by four panels connected to each other by three hinges, and slides between a two-seat back to back structure and an elongated surface. However, Huse fails to appreciate or address the problems associated with the instant invention, in that the even when converted into a reclined position, there is limited space to feel safe and comfortable.

U.S. Pat. No. 5,799,605 issued to Huse discloses an EXPANDABLE BOAT SEAT. Huse discloses a boat seat assembly which expands the length of the seat by sliding the frame of the seat inward and outward from the base of the seat. However, Huse fails to provide a seat that can expand the size of the seat to be used by more than one person. Huse does not address, nor was concerned with the problems eliminated by the instant invention.

U.S. Pat. No. 4,854,261 issued to Goldsmith discloses a COMBINATION SEAT FOR BOATS. Goldsmith discloses a combination of seats which face back to back and are expandable to form a surface on which a single user can recline. Further, Goldsmith discloses a provision for a galley and a sink underneath the seat combinations, but does not address the problems addressed by the instant invention.

As has been described, the prior art does not address, or overcome, the problems with multiple user utility and practicality within a boat. Accordingly, what is needed is an assembly which can convert a seat on a boat to a large flat surface for multiple person lounging while simultaneously providing practical storage capabilities. It is therefore, to the effective resolution of the aforementioned problems and shortcomings of the prior art that the present invention is directed. However, in view of the boat seat designs in existence at the time the present invention was completed, it was not obvious to those persons of ordinary skill in the pertinent art and marine industry as to how the identified needs could be fulfilled.

SUMMARY OF THE INVENTION

The present invention provides inventive subject matter which overcomes the above described problems. The present invention contemplates a boat seat assembly that can alternate between three distinct positions which may provide three distinct uses. The seat assembly has a first state in which two distinct seats separated by a central walkway maintain an upright position, a second state in which the two distinct seats recline and extend to create two separate flat surfaces, and a third state in which independent panels and an elongated pad are used to fill the space between the two distinct seats in order to create a sunpad with a large surface area.

The seat assembly is mounted to the deck of a standard open-top boat. The seat assembly has two separate seat structures which are side by side with a space between them. The seats each have seating platforms which have a bow-facing side, a stern-facing side, a port-facing side and a starboard-facing side. Each seating platform will be hollow and will have an open top. Recessed areas are located on the outside of the starboard-facing and port-facing sides of each seating platform and extend from the top to a designated position below the top. The open top of each seating platform will be covered by a lid structure which will be attached to the seating platform through the use of hinges, so the user may access the hollow center of the seating platform when desired. The hinges are located on the stern-facing side. The lid structure will have a bow-facing edge, a stern-facing edge, a starboard-facing edge, and a port-facing edge. Along the port-facing edge of each lid there is a section cut-out. Along the starboard-facing edge of each lid there is a section cut-out. Each cut-out section will be placed directly above the recessed area located on the port-facing and starboard-facing sides of each seating platform.

The novel seat assembly includes a seat bottom having a shape which comprises a front portion of a width substantially similar to the width of the lid structure and a back portion of a width narrower than the width of the lid structure. The seat bottom has a backing board with a top side and a bottom side. A padded section is affixed to the top side of the backing board. A hand rail is mounted to the bottom side of the backing board. The hand rail is mounted such that a section of the hand rail extends out from underneath the seat bottom and toward the center walkway of the boat so a user can hold onto it. A support rail also is mounted to the bottom side of the backing board. The support rail is mounted to the backing board on the opposite side of the hand rail. Both the hand rail and the support rail are mounted such that there is ample space between them.

The seat bottom is connected to the lid structure through a novel sliding mechanism. The sliding mechanism consists of many parts, some of which are mounted to the seat bottom and others which are mounted to the lid structure. The sliding mechanism is equipped with a locking mechanism that is spring activated and holds each seat bottom in a fixed location on the lid structure.

The novel seat assembly includes a pair of bracket mechanisms mounted directly underneath each cut-out section on each lid structure. The bracket mechanisms extend from the lid structure into the recessed area in the starboard-facing and port-facing sides of each seating platform. Each bracket mechanism has a receptacle device with an open top end and a bottom end. The receptacle on each bracket mechanism has an elongated cut-out track extending from a location near the bottom end to a location near the top end. The location near the bottom end is of greater width than the rest of the track and has a substantially circular shape. The cut-out track ends at the top of the receptacle at a location slightly above top of the lid structure. Each bracket mechanism is equipped with a spacer device to protect the seating platform from any accidental contact. The spacer device has a similar shape to the recessed area in which the bracket mechanism is located. Each bracket mechanism and spacer is protected by a cover which has a similar shape to the recessed area in which the bracket mechanism is located.

The novel seat assembly includes a seat back structure. The seat back structure has two parallel legs which are separated by a distance equal to the distance between each bracket mechanism on each lid structure. Each leg has a top end and a bottom end. The bottom end has an aperture drilled through it. Each bottom end is inserted through a cutout section on the lid structure and into a designated receptacle on a bracket mechanism. Each leg is movably secured to the receptacle mechanism on the bracket mechanism through the use of a device that extends inwardly through the elongated cut-out track section on the receptacle and into the elongated tube through the aperture at the bottom end. The top end of each leg extends upwardly through the cut-out section. An arched tube extends from the top end of one leg to the top end of the other leg. A stabilizing member extends perpendicularly between the two legs at a location along each parallel leg below the top end, but above the lid structure. A back pad or cushion is secured between the arched tube and the stabilizing member on the seat back structure.

The seat back structure is in the upright position when the bottom end of the parallel legs are completely inserted into the receptacle of the bracket mechanism such that the aperture located at the bottom of the leg is aligned with the large cut out area at the bottom end of the cut-out track of the receptacle. The seat back structure is changed into a reclined position by moving the bottom end of the legs to the top end of the cut-out track on the receptacle. The seat back structure is then rotated backward to rest on the back section of the lid structure and into the same planar direction as the seat bottom. The seat back structure is supported in this reclined position by the lid structure. When the seat back structure is in the reclined position, the seat back pad lies flush with the back edge of the seat bottom pad and the parallel legs extend along and parallel to the port-facing and starboard-facing sides of each lid structure. When the seat back structure is in the reclined position and the seat bottom is moved forward along the sliding mechanism, a space is created between the seat back pad and the seat bottom pad. The novel inventive subject matter thus, further includes a removable pad that has substantially equal dimensions to the space between the seat back pad and the seat bottom pad. In addition, the width of the removable pad is substantially equal to that of the back portion of the seat bottom. Thus, when the removable pad is placed onto the lid structure, a portion of the lid structure remains exposed. When not in use, the removable pad is stored within the hollow center of the seating platform.

The novel inventive subject matter further includes the ability to form a large sunpad. A flat and substantially rigid forward central panel is secured between the exposed portion of the lid structure of one seat and the lid structure of the other seat. This forward central panel has side edges which are shaped to contour to the shape of the lid structure and seat bottom. A flat and substantially rigid aft panel is secured between the exposed portion of the lid structure of one seat and the lid structure of the other seat. This aft panel has side edges which are shaped to contour to the shape of the lid structure and elongated parallel tubes of the seat back structure in the reclined position. The forward and aft central panels have the ability to fold into multiple sections through the use of hinges that create several distinct sections. An elongated pad is set on top of the forward and aft panels. The elongated pad has a length that extends from the front edge of the seat bottom pad to the arched tube on the reclined seat back structure. The elongated pas has side edges which are contoured to follow the sides of the seat bottom pad, the removable pad, and the parallel elongated tube. The elongated pad can be folded into a desired number of sections. When not in us, the elongated pad and the forward and aft central panels are stored in the hollow center of the seating platforms.

In accordance with the instant invention, it is an object thereof to provide an improved seating assembly mounted to the deck of a boat, which can change from a pair of upright chairs to a pair of recliners to one large sunpad.

It is a further object of the instant invention to provide easy storage for all the individual pieces used to create the three distinct positions described above.

It is a further object of the instant invention to provide an improved mechanism for sliding the bottom of a seat backward and forward and locking the seat in one place.

These and other objects, advantages, and features of this invention will become clear as this description proceeds hereinafter. The invention accordingly comprises the features of construction, manufacturing methods, engineering designs and components, the interrelationship thereto, combination of elements, and arrangement of parts that will be exemplified in the description set forth hereinafter.

In accordance with these and other objects which will become apparent hereinafter, the instant invention will now be described with particular reference to the accompanying drawings.

DETAILED DESCRIPTION

Figure 1:
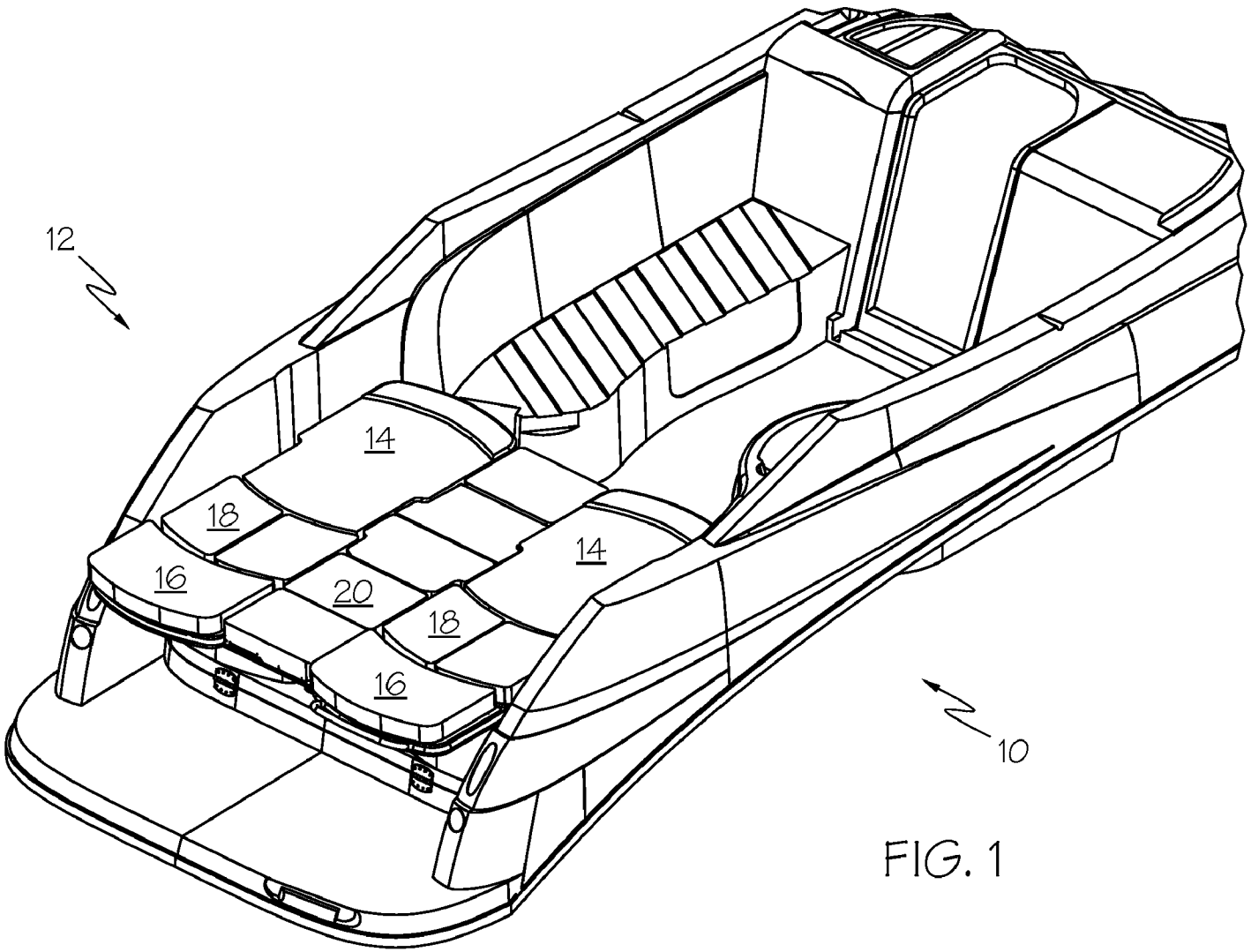
FIG. 1 is a perspective view of a boat and deck assembly incorporating the instant invention.

Turning to FIG. 1, a perspective view of a stern area of a boat 10 is illustrated, including port gunnel, and starboard gunnel. This particular boat includes a conventional deck. However, it is to be appreciated that any boat type or design could incorporate the instant invention. Seat assembly 12 is shown near the stern of the boat 10, however, as will be appreciated by one of ordinary skill in the art, alternative locations can be utilized. As shown, the seat assembly 12 is in a reclined sunpad state. The mechanics of the seating assembly 12 will be described hereinbelow. As shown, the seating assembly 12 has two separable seats each having a platform 14 and a back support structure 16. As shown, in the sunpad state, additional pads 18 are inserted between the platform 14 and the back support structure 16. As further shown, a removable section 20 may be set between the two seats in order to create a large surface area sunpad.

Figure 2:
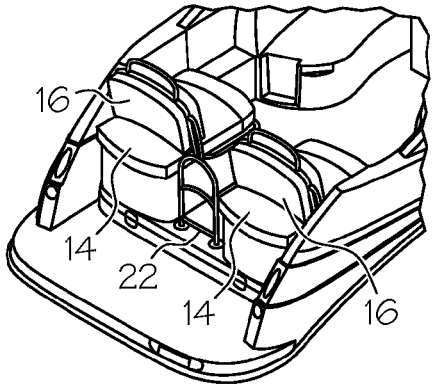
FIG. 2 is a perspective view of a boat and deck assembly incorporating the instant invention in the upright position.

With reference to FIG. 2, a perspective view of the stern section of the boat 12, shown in FIG. 1, is depicted. In this particular view, the first seat and the second seat are depicted in an upright position. As shown the first seat and second seat are mounted side by side with space between them. As shown, each seat has a platform 14 which rests horizontally and is contemplated to have a cushion on which a user may sit. As shown, each seat has a back support structure 16. Each back support structure may sit upright, as depicted in FIG. 2, or may recline, as depicted in FIG. 1. Each back support structure 16 is contemplated to have a cushion. As further shown in FIG. 2, the seats may be separated by a removable transom gate 22 mounted to the deck.

Figure 3:
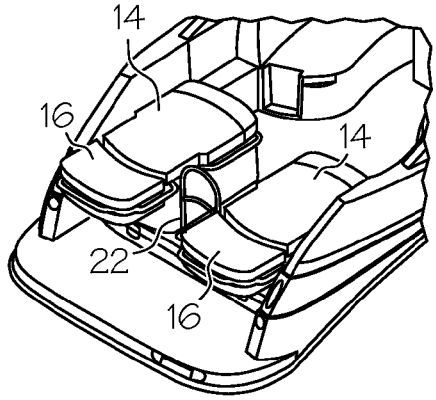
FIG. 3 is a perspective view of a boat and deck assembly incorporating the instant invention with the seat backs in a reclined position.

With reference to FIG. 3, a perspective view of the stern section of the boat 12, shown in FIG. 1, is depicted. In this particular view, the first seat and the second seat are depicted in a reclined state with the back support structure 16 reclined to provide a nearly continuous planar surface across the platform 14 and the reclined back support 16.

Figure 4:
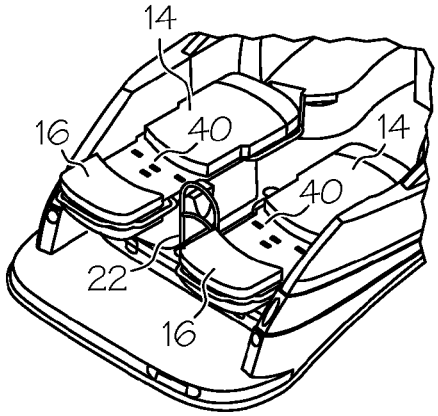
FIG. 4 is a perspective view of a boat and deck assembly incorporating the instant invention with the seat backs in a reclined position and the seat pads in a forward position.

With reference to FIG. 4, a perspective view of the stern section of the boat 12, shown in FIG. 1, is depicted. In this particular view, the first seat and the second seat are depicted in a reclined state with the back support structure 16 reclined and the platform 14 slid forward along the top surface 40 of the seat. As shown, a space is created between the back support 16 and the platform 14.

Figure 5:
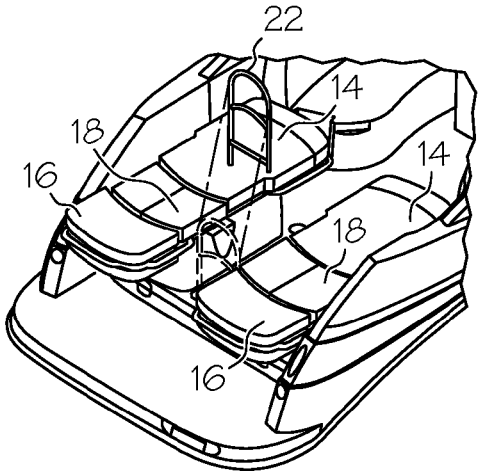
FIG. 5 is a perspective view of a boat and deck assembly incorporating the instant invention with the seat backs in a reclined position and the seat pads in a forward position and the transom gate removed and a pad inserted between the seat back and seat pad.

With reference to FIG. 5, a perspective view of the stern section of the boat 12, shown in FIG. 1, is depicted. In this particular view, the first seat and the second seat are depicted in a reclined state with the back support structure 16 reclined and the platform 14 slid forward. A cushion or pad 18 is shown to be inserted into the space between the back support 16 and the platform 14. By inserting this additional cushion 18, each seat may operate as an elongated reclining surface for the user. As further shown, the transom gate 22 may be removed from the deck of the boat.

Figure 6:
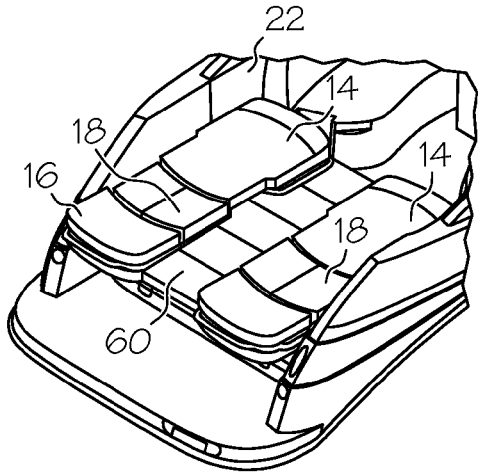
FIG. 6 is a perspective view of a boat and deck assembly incorporating the instant invention with the seat backs in a reclined position and the seat pads in a forward position and a foldable panel inserted between the seating platforms.

With reference to FIG. 6, a perspective view of the stern section of the boat 12, shown in FIG. 1, is depicted. In this particular view, the first seat and the second seat are depicted in a reclined state with the back support structure 16 reclined and the platform 14 slid forward. A cushion or pad 18 is shown to be inserted into the space between the back support 16 and the platform 14. By inserting this additional cushion 18, each seat may operate as an elongated reclining surface for the user. As further depicted, a foldable panel 60 is inserted into the space between the first and second seats. The panel 60 will have a shape to conform to the edges of the top surface of the seat 40. When in use, the panel is contemplated to support the weight of a human.

Figure 7:
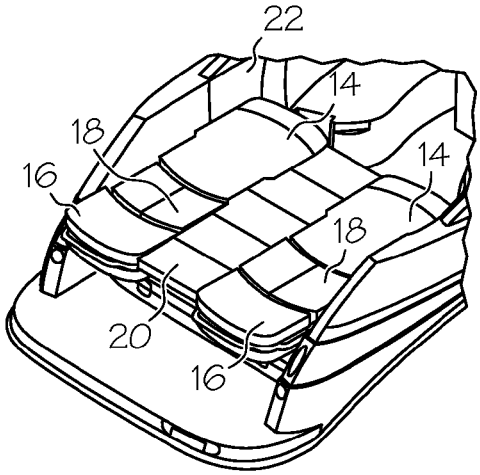
FIG. 7 is a perspective view of a boat and deck assembly incorporating the instant invention with the seat backs in a reclined position and the seat pads in a forward position and a foldable panel inserted between the seating platforms and a pad set on top of the foldable panel.

With reference to FIG. 7, a perspective view of the stern section of the boat 12, shown in FIG. 1, is depicted. In this particular view, the first seat and the second seat are depicted in a reclined state with the back support structure 16 reclined and the platform 14 slid forward. A cushion or pad 18 is shown to be inserted into the space between the back support 16 and the platform 14. By inserting this additional cushion 18, each seat may operate as an elongated reclining surface for the user. As further depicted, a pad or cushion 20 is placed on to the foldable panel 60 (shown in FIG. 6) to provide a comfortable surface. The pad or cushion 20 is contemplated to have a shape which conforms to the space created between the platforms 14, thus producing a nearly continuous planar surface or sunpad on which a user or multiple users may sit.

Figure 8:
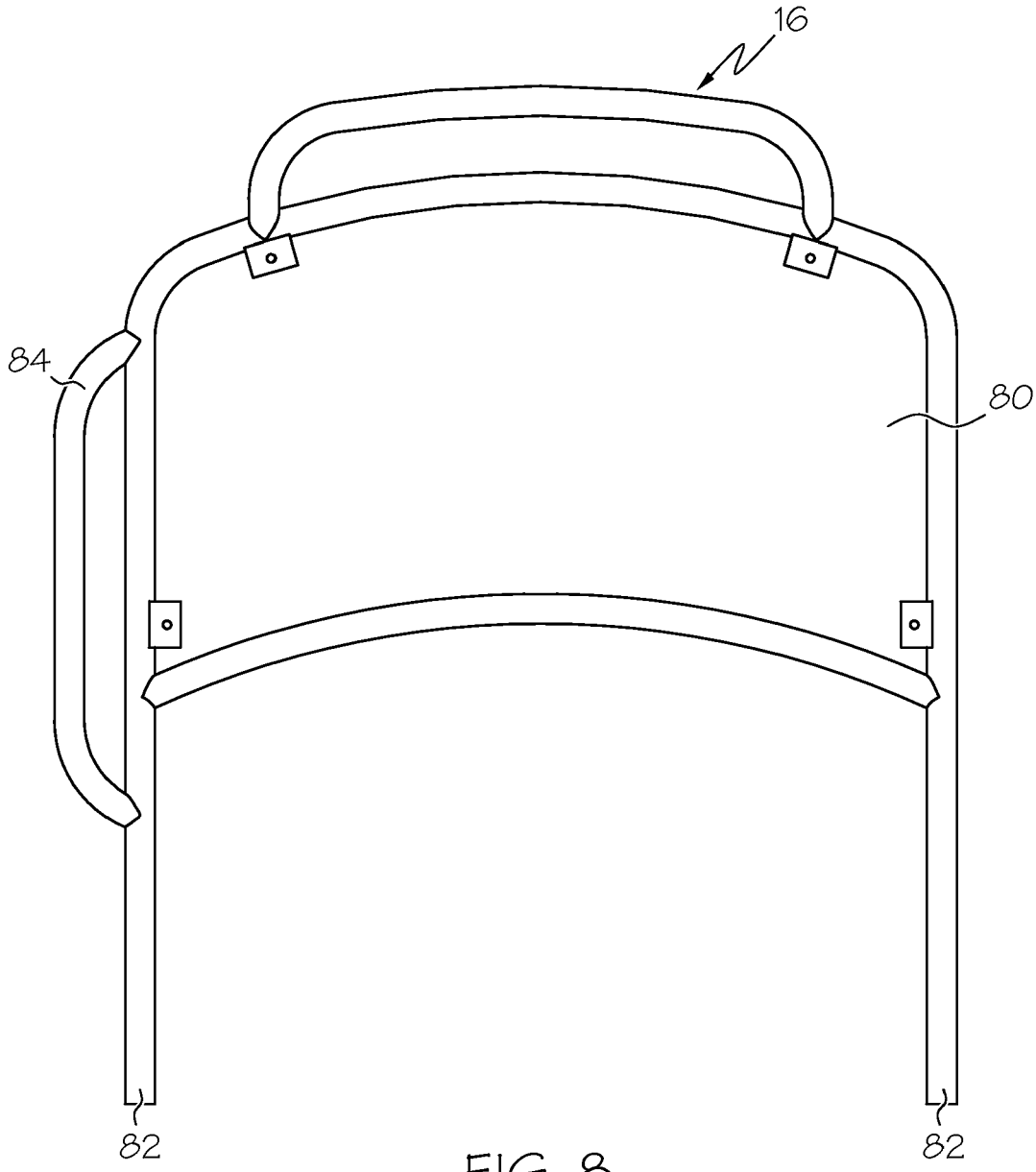
FIG. 8 is a plan view of a seat back.

With reference to FIG. 8, an isolated plan view of a back support structure 16, as described in FIGS. 1-7, is shown. Each back support structure 16 has a pad or cushion 80 fit between a frame containing two parallel legs 82. The frame additionally is contemplated to have a side rail 84. Each back support structure 16 will be mounted such that the side rail 84 faces the opposite seat. It is additionally contemplated that the side rail 84 will provide a support for the folded panel 60 when the back support structure 16 is reclined.

Figure 9:
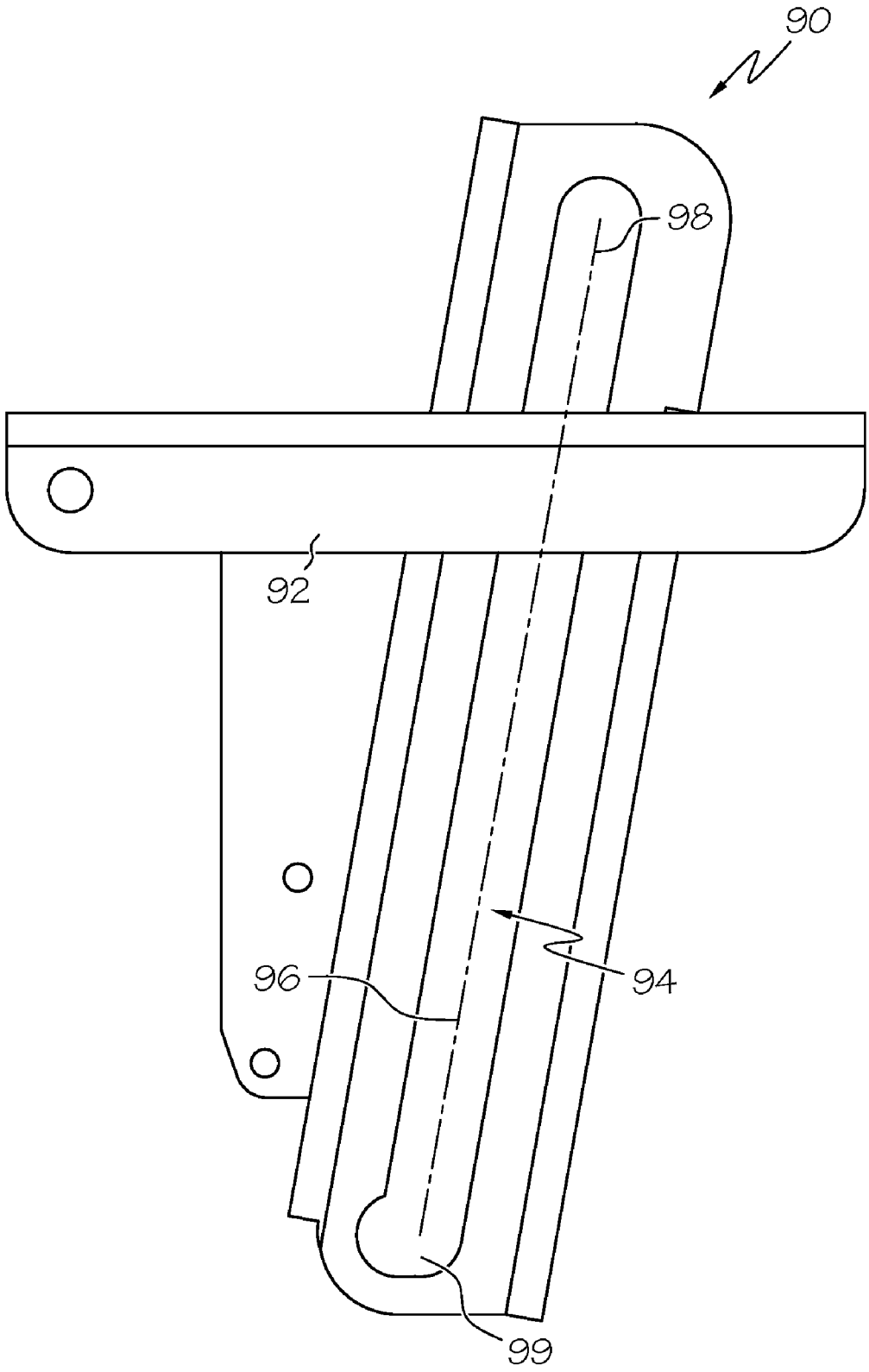
FIG. 9 is a side plan view of a seat back bracket.

With reference to FIG. 9, an isolated plan view of a bracket mechanism 90 is shown. One bracket mechanism 90, in use, is installed on each side of each seat. In use, a leg 82 (shown in FIG. 8) of each seat back structure 16 (shown in FIG. 8) i secured within each bracket mechanism 90. As shown, the bracket mechanism 90 has a horizontal section 92, which provides a mount to the side of each seat. The bracket mechanism 90 further has an angled vertical section 94 into which each leg 82 is inserted. The vertical section 94 is contemplated to have a cylindrical shape with an open top and a closed bottom. The vertical section 94 is further contemplated to have an elongated cut-out section 96 which extends almost the entire length of the vertical section. The legs 82 of the back support mechanisms 16 are inserted into the top of the vertical section 94 and are secured with a securing device through the elongated cut-out section 96. The securing device will secure to the bottom of each leg 82. It is contemplated that such as securing device may be a secure or nut and bolt. It is contemplated that the legs 82 will be secured such that it may slide upwards and downwards from the bottom 99 of the cut-out section 96 to the top 98. When the securing device is at the bottom 99, the back support 16 will be in the upright position. When the securing device is at the top 98, the back support 16 may be reclined into the reclined position. Thus, the action of the legs 82 is to slide upwardly and downwardly within the vertical section 94 of the bracket mechanism 90.

Figure 10:
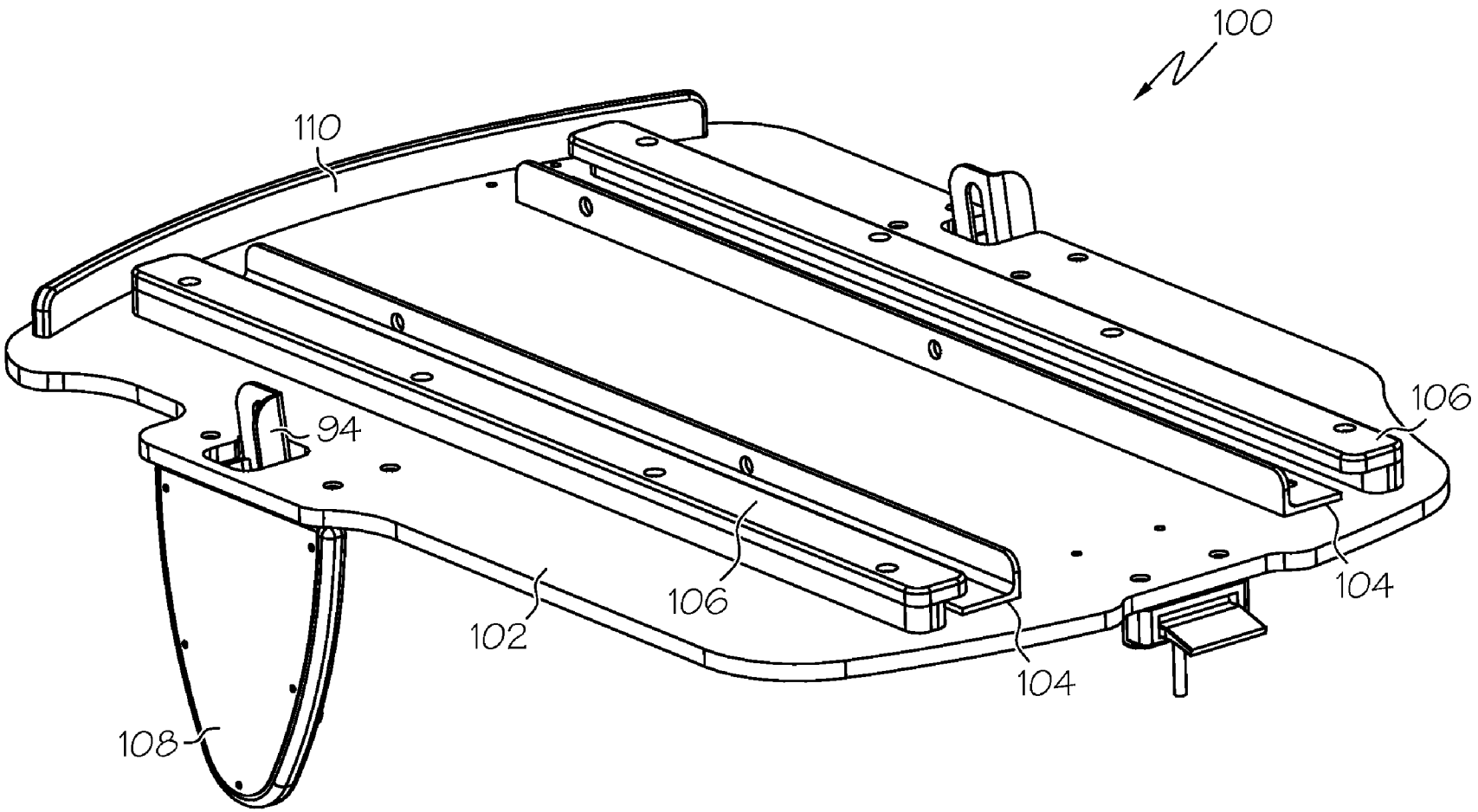
FIG. 10 is a top perspective view of a lid assembly.

With reference to FIG. 10, an isolated top perspective view of the platform 100 secured to the top of each seat is shown. The platform 100 contains part of the mechanism allowing the seat platform to slide backwards and forwards. The platform 100 is contemplated to have two sets of parallel tracks secured. The platform comprises a rigid panel 102. The bottom elongated track section 104 have a shape like an "L" with the horizontal portion mounted to the platform and the vertical portion extending upwardly. The top elongated track sections 106 have a vertical section secured to the platform 100 and a horizontal section extending slightly over the horizontal portion of each bottom track 104. Thus, a space is created between the bottom 104 and top 106 sections. A stopper mechanism 110 is contemplated to be secured to the front end of the platform panel 102. As shown, the vertical section of the bracket mechanism extends upwardly through cut out sections in the panel 102 found on either side of the panel 102. It is further contemplated that a bracket cover 108 may be used to protect the bracket 90.

Figure 11:
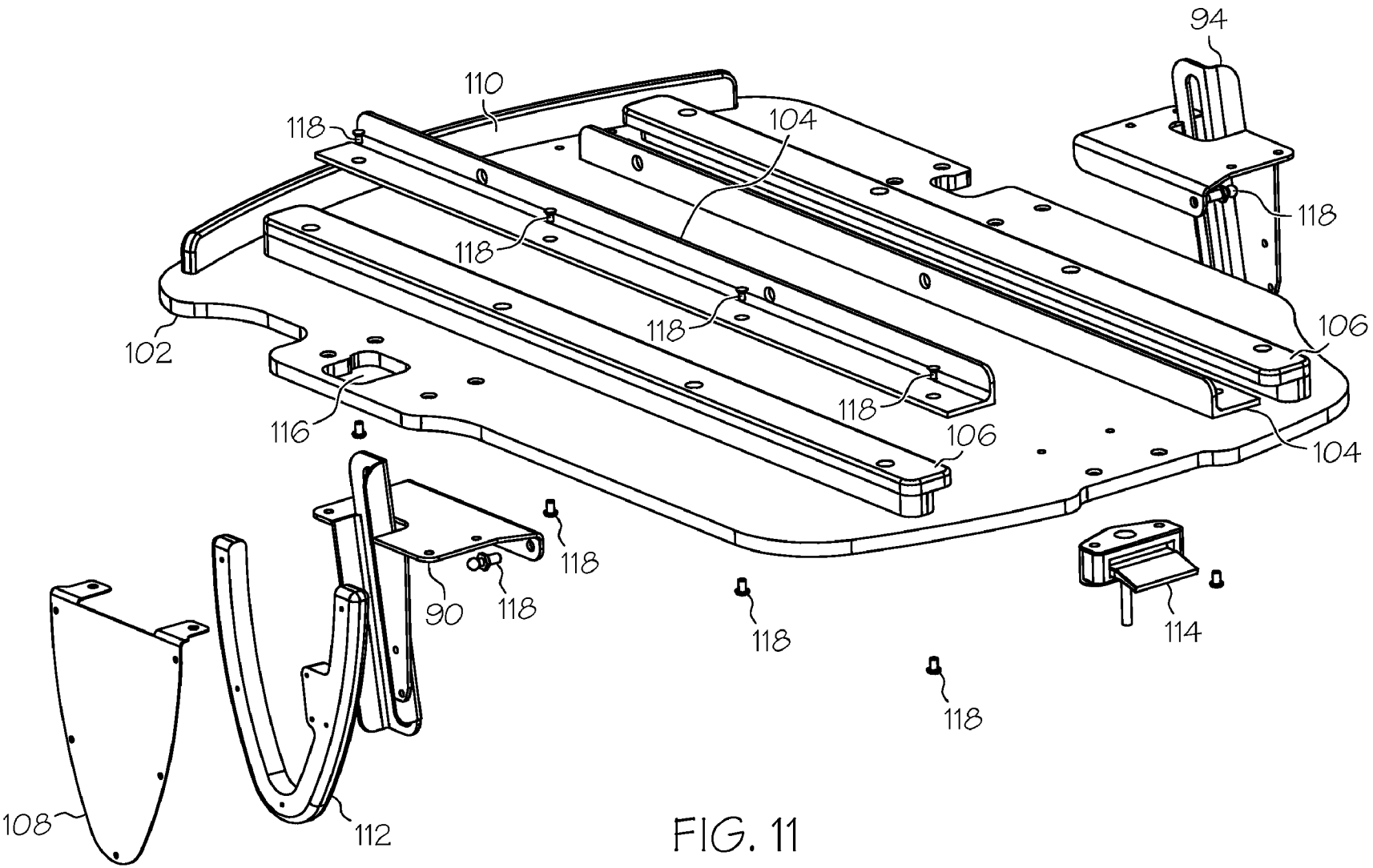
FIG. 11 is a perspective exploded view of the lid assembly shown in FIG. 10.

With reference to FIG. 11, an exploded perspective view of the platform 100 shown in FIG. 10 is shown. As shown, the panel 102 has a cut out section 116 on each side. As shown, it is contemplated that securing mechanisms, such as screws, 118 are used to secure the tracks, 104, 106 to the panel 102. As further shown, a spacer 112 may be used to protect the bracket 90 from the bracket cover 108. As further shown, a slam latch 114 may be secured to the panel 102 to aid in the ease of opening and closing the panel. Ash displayed, screws 118 may be used to mount track sections 106 from underneath the panel 102 and screws may be used to secure the bottom tack sections 104 from above the panel 102. As shown, screws 118 are contemplated to be used to mount the bracket mechanisms 90 to the seat or also to the panel 102.

Figure 12:
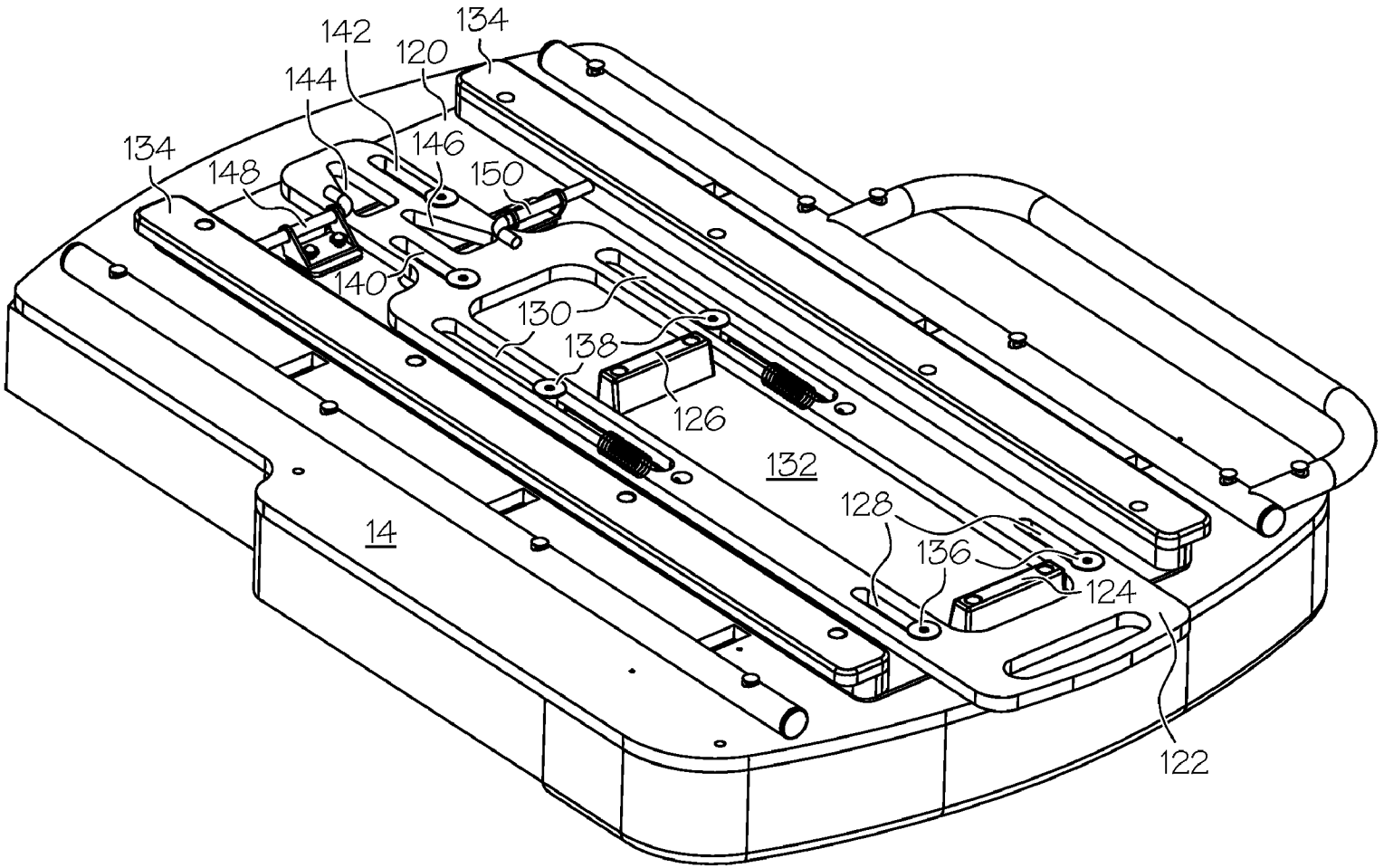
FIG. 12 is a bottom perspective view of the seat bottom assembly.

With reference to FIG. 12, an isolated perspective view of the platform 14, or seat assembly, is shown flipped upside down. The platform 14 contains the marching portion of the sliding mechanism to that found on the above described platform 100. A rigid panel 120 is contemplated to be mounted to the seat 14. As shown, an "L" shaped track 134 is secured to either side of the seat 14 panel 120. The tracks 134 are shaped and sized to fit into the space produced by the tracks 104, 106 in the platform 100 shown in FIG. 11. As shown, a handle 122 is secured to the panel 120. The handle 122 is secured in a parallel manner to the tracks 134. The handle has a pair of elongated apertures 128 which allow for screws 136 to be inserted and mounted in to the panel 120. There are additionally a pair of longer apertures 130 on the handle 122 also accepting screws 138. These screws 138 are secured to resistance springs attached to one end of the handle 122. The handle has a large rectangular aperture in the center 132. A narrower section of the handle 120 has a pair of oppositely arranged triangular apertures 144, 146 and a pair of oppositely placed elongated apertures 140, 146. These apertures also receive screws. As shown, it is contemplated that a pair of oppositely facing spring mounted locking mechanisms 148, 150 are mounted to the panel 120. The locking mechanisms 148, 150 have an "L" shaped rigid piece with the horizontal end entering each triangular aperture 144 and a pointed horizontal end having the ability to enter a series of apertures found along the vertical section of each track 134. A pair of stopper mechanisms 124, 126 are mounted within the rectangular aperture 132. In use, the user pulls the handle 122 forward, and the vertical sections of each locking mechanism 148, 150 are forced out of an aperture along the track 134 by the shape of the triangular apertures 144, 146. This allows the seat platform 14 to be slid forward within the tracks 104, 106 of the seat panel 100. When the handle 122 is released, the locking pins of the locking mechanism 148, 150 are re-inserted into the apertures of each track 134.

Figure 13:
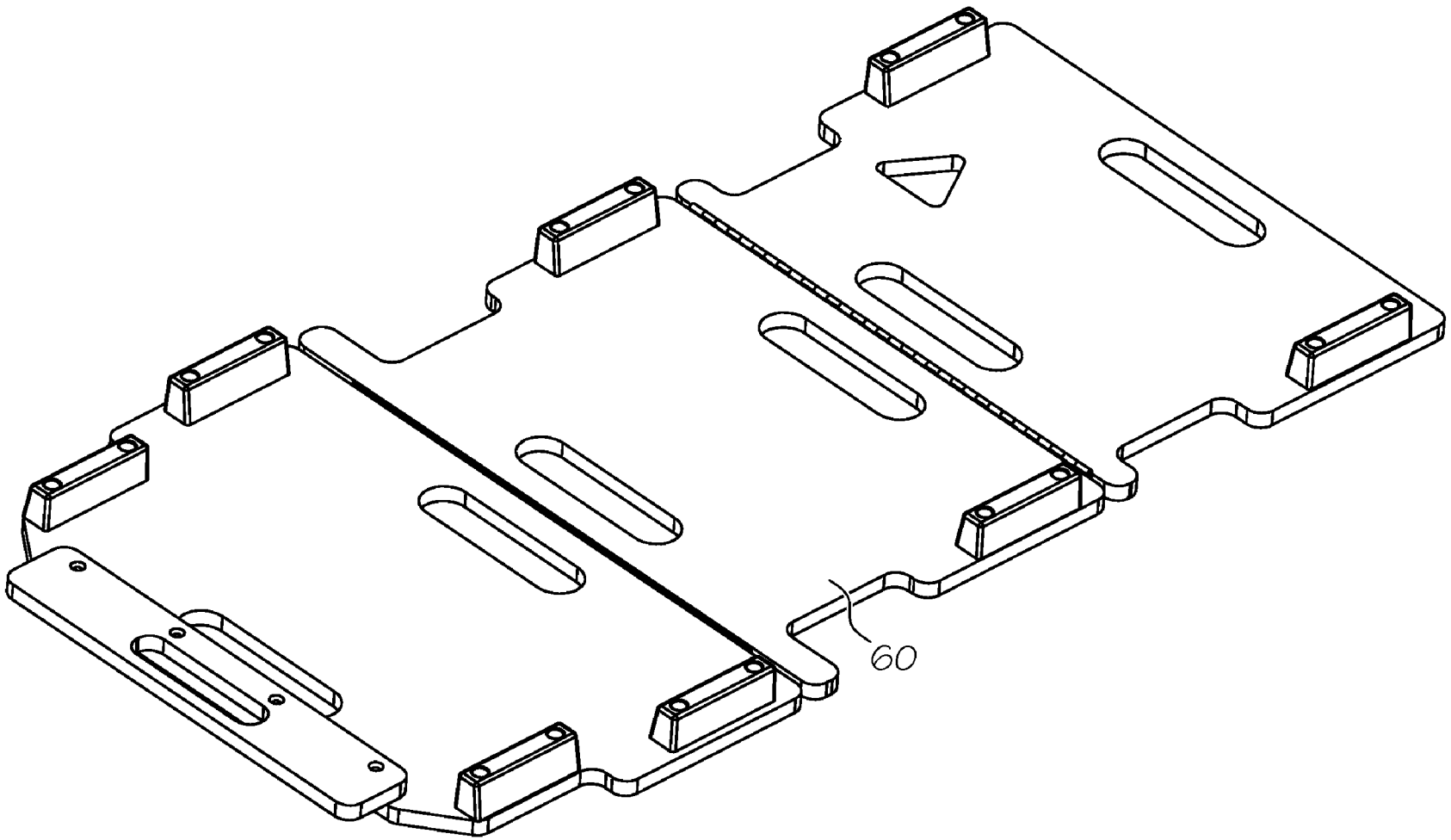
FIG. 13 is a top perspective view of the filled panel assembly.

With reference to FIG. 13, a top isolated perspective view of a removable panel 60 is shown. It is contemplated that such a panel 60 may have one, two, three, four or five separate sections each may be connected by hinges, allowing it to be stored. It is contemplated that this panel 60 is inserted between the two seats, as described in FIG. 6. The edges of the panel 60 corresponds to the contours of the seats, so as to provide maximum stability. Pads may be placed on top of the panel 60, as described in FIG. 7. It is contemplated that the seat structures may be hollow for storage, and the panels 60 and pads may be stored within the seats when not used.

Figure 14:
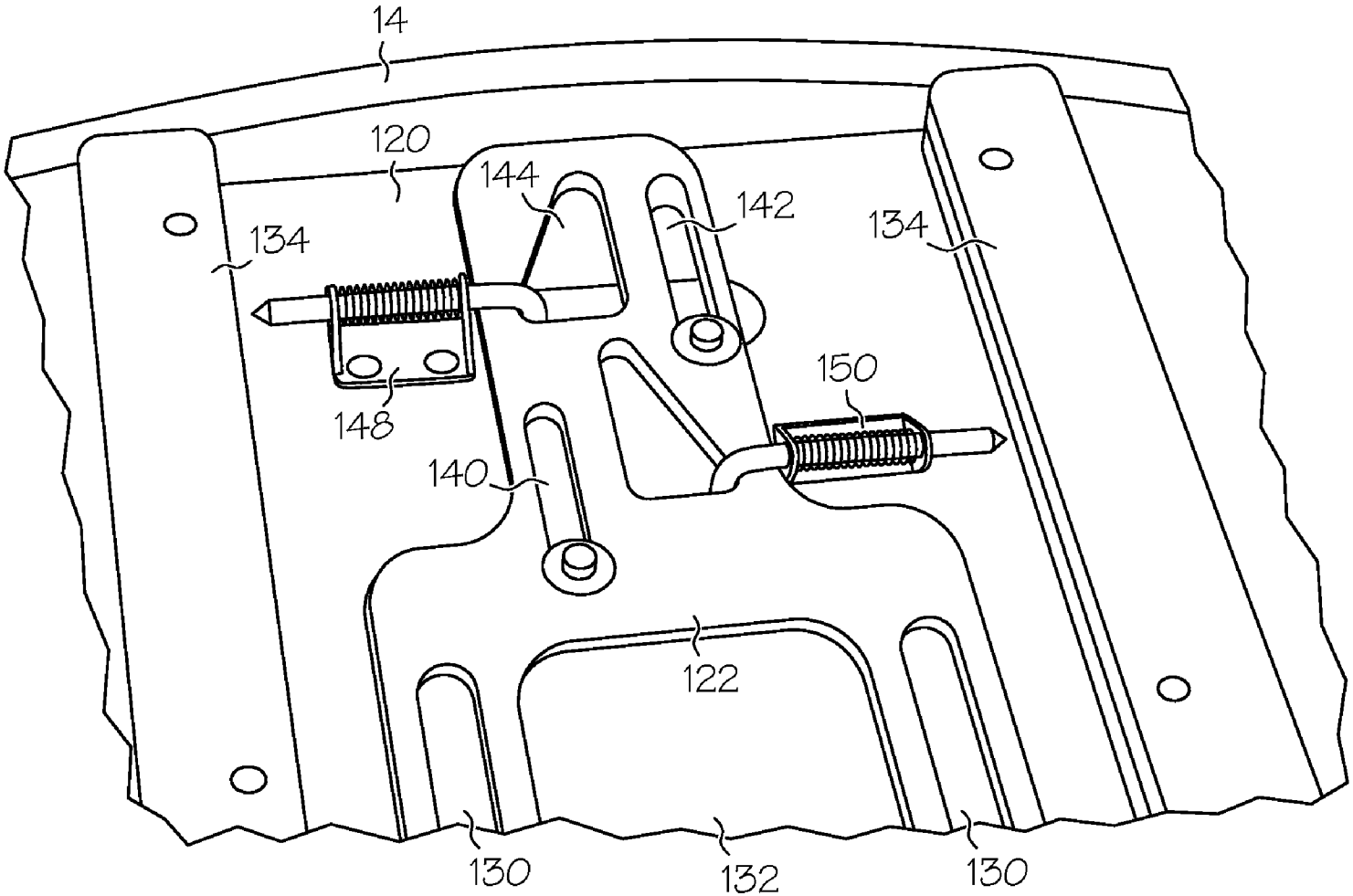
FIG. 14 is a top perspective view of the sliding mechanism in use.

With reference to FIG. 14, an enlargened perspective view of the handle 122, tracks 134 and locking mechanisms 148, 150 are shown. As shown, the locking mechanisms have resistance springs which provide resistance against the vertical sections of the locking pins when they are forced upwardly along the angled edge of the triangular apertures 144.

Figure 15:
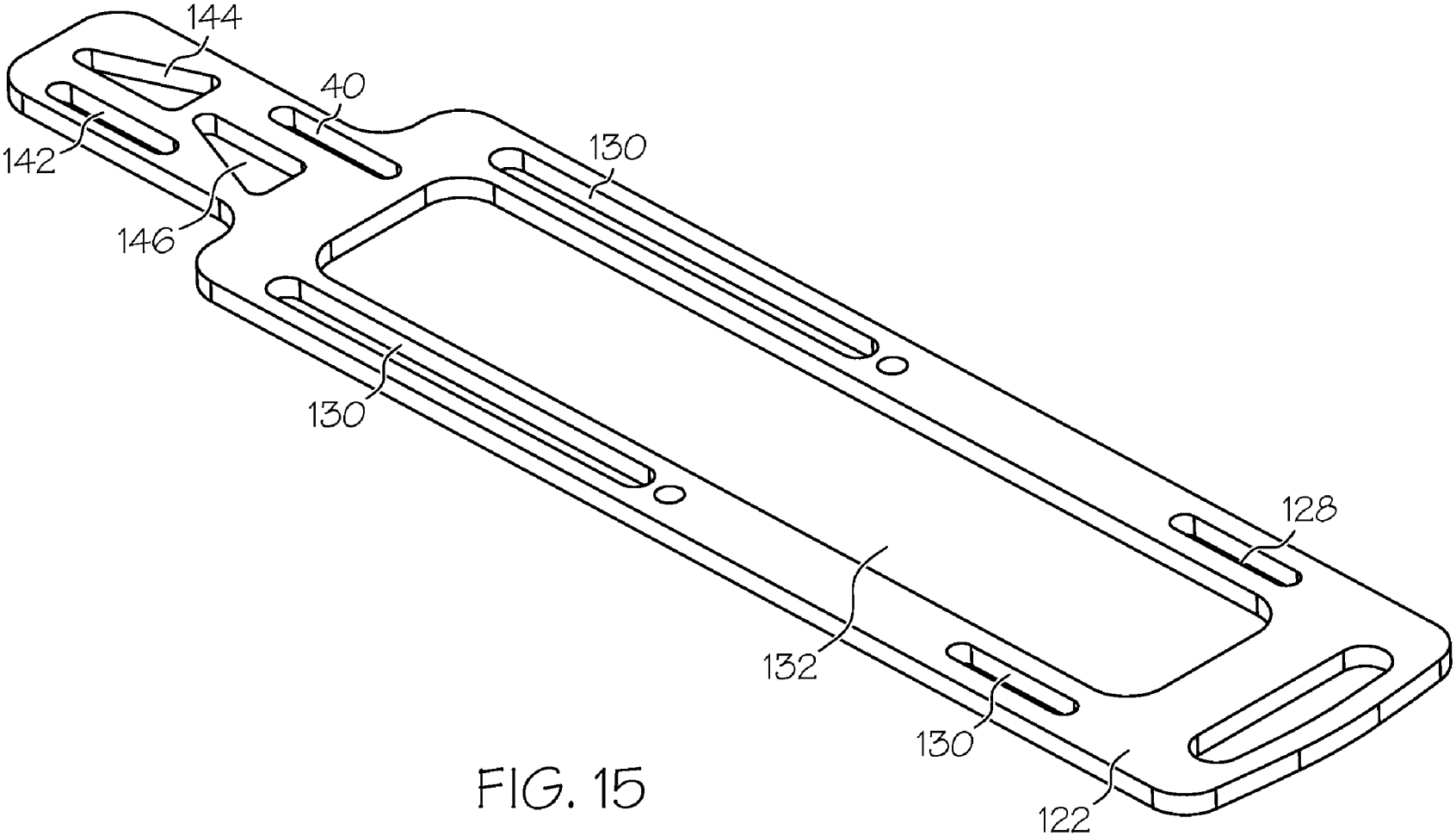
FIG. 15 is a top isolated perspective view of the handle of the sliding mechanism.

With reference to FIG. 15, an enlargened isolated perspective view of the handle 122 is shown, exemplifying the apertures and shapes used to further enhance the operability of the sliding and locking mechanisms.

The seating platform is shown as being mounted on the deck. A lid is shown as resting on the top of the seating platform and attached to the stern side of the seating platform with a hinge. A seat bottom structure is shown as being connected to the top of the lid. A bracket mechanism is shown to be located within a recessed section near the midpoint of the top edge of the port side. The top of the bracket mechanism extends upward to a point just beyond the top of the lid. One of the parallel legs of the seat back structure is shown as inserted into the bracket mechanism. A seat back pad is shown at the opposite end of that entering the bracket mechanism.

There are mounting devices which are used to mount the bracket mechanism to the underside of the lid. An elongated receptacle extends in a downward angle from the mounting devices. The instant invention incorporates a cylindrical shaped receptacle, however it is to be appreciated that alternative shapes may be appreciated by one of ordinary skill in the art. A track is cut out along the side of the receptacle extending from a position near the top of the receptacle to a position near the bottom of the receptacle. The top of the track extends slightly above the level of the top of the lid. At the bottom of the track is a larger open area. The bottom end of each parallel leg has an aperture drilled through it. The leg is inserted into the receptacle and a screw is inserted through the large open area in the track and through the aperture in the leg. The screw prevents the leg from becoming disconnected from the receptacle. When the seat back structure is in an upright position, the screw, aperture, and legs rest in the large area at the bottom of the track. When the seat back structure is in a reclined position, the screw, aperture, and legs rest at the top of the track and the legs are rotated backwards to rest on the top of the lid. A curved spacer is attached around the bracket mechanism to prevent the bracket mechanism from rubbing against the seating platform. The spacer has substantially the same shape as the recessed section in the side of the seating platform. A substantially flat cover is mounted to the spacer and has the same shape as the spacer. The cover protects the spacer and bracket mechanism from potentially detrimental elements.

The two parallel legs are shown with each leg having an aperture drilled through the bottom of each leg. A seat back pad is shown as being secured between the top ends of the two legs. The seat back pad may be a cushion, however, as will be appreciated by one of ordinary skill in the art, any type of pad can be utilized.

The figure depicts the shape and size of the seat bottom structure and the seat back pad. The seat bottom structure has a shape with two distinct sections of different dimensions. The front section has substantially equal width as the lid. The aft section has narrower width than the lid. An exposed portion of the top of the lid is shown along the outside of the aft section. The figure depicts the parallel legs rotated backward and resting on the exposed portions of the tops of the lid.

The figures depict part of the sliding mechanism which connects the seat bottom structure to the lid. A cut-out section is shown on the port side of the lid and a cut out section is shown on the starboard side of the lid. A pair of retainers are mounted to the top of the lid at a location near the port side and starboard side. The retainers are raised and have an overhang that extends toward the center of the lid. The retainers extend from a point near the front edge to a point near the aft edge of the lid. A pair of "L" shaped slider shims are mounted to the lid such that the horizontal surface is underneath the overhang of the retainer and the vertical surface raises perpendicularly from the lid to a height substantially equal to that of the overhanging retainer. The figure depicts the plurality of apertures located along the vertical surface of the shims. The figure depicts a lip structure mounted along the front edge of the lid in order to provide protection.

The figures depict the two distinct parts of the seat bottom structure. The backing board is on the bottom side and the seating pad is secured to the top side. The figure provides further representation of the front section of width substantially equal to the lid and the aft section of width narrower than the lid. A rail is mounted to the backing board. The rail has an elongated section which is mounted to the backing board very near the side closest to the center of the seat assembly. The rail is mounted to the port side of the first seats bottom backing board and is mounted to the starboard side of the second seat bottom backing board. The elongated section extends from the front side to the aft side of each backing board. A hand rail section extends outwardly from the elongated section for a distance equal to the length of the front section of the seat bottom structure. The hand rail extends outwardly toward the direction of the center of the seat assembly. An elongated support rail is mounted to the side of the backing board opposite the hand rail. The elongated support rail extends from the front side to the aft side of the backing board and provides stability to the seat bottom structure.

The figure further depicts part of the sliding mechanism that connects the seat bottom structure to the top side of the lid. A substantially flat spacer is mounted to the backing board. A pair of retainers are mounted to the port and starboard edges of the flat spacer. One retainer is mounted inside and parallel to the elongated section of the hand rail. Another retainer is mounted inside and parallel to the elongated support rail. The retainers have raised and overhanging sections which overhang in a direction away from the center of the backing board. The retainers are mounted in a particular location and have particular dimensions allowing them to be inserted into the track created by the overhang on the retainers on the lid and the slider shims on the lid. When inserted, the slider mechanism is complete and functional.

The figure further depicts the stopping mechanism which locks the sliding mechanism in place. The stopping mechanism consists of a pair of cleats mounted to the flat spacer in a location centrally between the retainers. A first cleat is mounted along the front edge of the flat spacer. A second cleat is mounted along the distinction line between the front and aft sections of the seat bottom backing board. The cleats or stopper mechanisms have an angled side and are mounted such that the angled sides face toward each other. A handle is secured between the pair of retainers on the backing board. The handle has a large rectangular section and a small rectangular section. The large rectangular section is secured closer to the front side of the seat bottom structure and the small rectangular section is closer to the aft side of the seat bottom structure. Within the large rectangular section there are several apertures. A large rectangular aperture is centrally located within the large rectangular section and is placed over the pair of cleats or stopper mechanisms. The large rectangular aperture is longer than the distance between the first and second cleats, thus allowing the handle to be pulled backwards and forwards in a rectilinear direction. A pair of short elongated track apertures are located on either side of the large rectangular aperture of the handle and extend from substantially the same level as the front edge of the large rectangular aperture to a desired distance toward the aft of the seat bottom structure backing board. A pair of long elongated track apertures are located on either side of the large rectangular aperture and extend from substantially the same level as the aft edge of the large rectangular aperture to a desired distance toward the front of the seat bottom backing board. A pair of circular apertures are located at the midpoint of either side of the large rectangular aperture very close to the front end of the pair of long elongated track apertures. A plastic spacer, washer and bolt combination is used to mount the handle to the flat spacer. The plastic spacer is inserted into each one of the short and long elongated track apertures. A washer is placed over each plastic spacer and rested on top of the handle. A bolt is inserted through the washer and plastic spacer and inserted into the flat spacer. This allows the handle to slide backwards and forwards. A pair of spring mechanisms are connected at one end to the circular apertures and at the other end to the bolt mounted within each of the long elongated track apertures. These spring mechanisms provide resistance when the handle is pulled in a forward direction. A gripping device is located on the front end of the handle outside the large rectangular aperture.

A pair of triangular apertures are located at opposite corners of the small rectangular section. The triangular apertures are arranged such that the aperture is widest near the front and narrowest near the aft side of the seat bottom. Shortest elongated track apertures are located in the corners of the small rectangular section opposite the corners occupied by the triangular apertures. A plastic spacer, washer, and bolt combination is inserted into each one of the shortest elongated track apertures. The washer is placed over each plastic spacer and rested on top of the handle. The bolt is inserted through the washer and plastic spacer and inserted into the flat spacer. This allows the handle to slide backwards and forwards. A pair of spring pin mechanism function jointly with the triangular apertures. The spring pin mechanism has a horizontal section with a pointed end which extends perpendicularly towards the retainers. The other end of each spring mechanism is vertical and extends through the top of each triangular aperture and rests within the bottom corner at the widest point of each triangular aperture. Between the vertical end and the pointed end is a spring that provides resistance against the spring pin being pulled toward the narrower part of each triangular aperture. When a user pulls the gripping device forward, the handle is pulled forward, thus causing the both vertical sections of each spring pin to be forced toward the narrower section of each triangular aperture. Because the part of the sliding mechanism located on the seat bottom is slid into the part of the sliding mechanism located on the lid in such a manner that the spring pin mechanisms align with the apertures located on the slider shims, when the handle is pulled forward, the pointed end of the pin is pulled out of the aperture. When the handle is released, the pointed end of the pin is inserted through the aperture. This describes the stopping and locking device.

The seat bottom structure is pulled forward along the sliding mechanism. A removable pad is inserted in the space created between the seat back pad and the seat bottom structure. A removable forward central panel is inserted in the space between the first seat and the second seat. The removable forward central panel is supported on either side by the top edges of the lids of each of the first and second seats when the seat bottom structure is pulled forward and an exposed portion is created. A removable aft central panel is inserted in the space between the first seat and the second seat. The removable aft central panel is supported on either side by the top edges of the lids of each of the first and second seats when the seat bottom structure is pulled forward and an exposed portion is created. The removable forward central panel and the removable aft central panel can support the weight of the user and can be used for lounging.

The seat bottom structure is pulled forward along the sliding mechanism. A removable pad is inserted in the space created between the seat back pad and the seat bottom structure. A removable elongated pad is inserted in the space between the first seat and the second seat. The removable elongated pad extends the length of both the forward and aft central panels. The removable elongated pad is set upon and supported by the forward and aft central panels. When set upon the forward and aft central panels, the removable elongated pad creates a sunpad with a large surface area on a boat and can support multiple users. The removable elongated pad can be folded into multiple sections when not in use by folding along the creased sections shown in the figure.

The removable panels are foldable into multiple separate sections connected by hinges. A plurality of cleats or stopper mechanisms are mounted at designated positions around the edges of the forward and aft central panels. These cleats touch the exposed portion of the lids when the forward and aft central panels are in use. The cleats provide protection against normal abrasions and also provide further stability. The instant invention depicts a forward central panel with three separate sections and an aft central panel with two separate sections, however, as will be appreciated by one of ordinary skill in the art, any number of sections can be utilized.

The opening of the lid is aided by a shock device attached at one end to the inside wall of the seating platform and at the other end to the bracket mechanism. The shock device applies an upward force and expands to keep the lid in an open position. The shock device compresses when the lid is in a closed position. The figures depict the bracket mechanism, spacer, and cover attached to the underside of the lid and removed from the recessed section of the seating platform when the lid is raised. When the lid is lowered to a closed position, the bracket mechanism inserts into the recessed section.

The first and second seats have storage capacity of the hollow center of each seating platform. The first seat can store the two removable pads and the forward central panel. The second seat can store the aft central panel and the folded elongated pad. However, as will be appreciated by one of ordinary skill in the art, alternative arrangements for storage may be utilized.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A seat assembly, said assembly comprising:

a first seat and a second seat;

a first back support structure secured to said first seat and a second back support structure secured to said second seat; and a first platform slidably mounted to the top surface of said first seat and a second platform slidably mounted to the top surface of said second seat;

said first and second back support structures having an upright state and a reclined state;

said first and second platforms sliding in a rectilinear direction fore and aft;

said first platform being slidably mounted to said first seat through a sliding mechanism;

said second platform being slidably mounted to said second seat through a sliding mechanism;

said first and second sliding mechanisms each comprising:

a pair of parallel tracks mounted to the top surface of the seat;

a pair of parallel track mounted to the bottom surface of the platform;

said seat tracks shaped to integrate with said platform tracks;

said platform tracks having a plurality of spaced holes;

a handle slidably mounted to said platform bottom surface between said pair of platform tracks;

said handle having a pair of elongated insertion pins; and said pins sized to removably insert into said platform track holes.

2. The seat assembly described in claim 1, further comprising:

at least one panel removably set between said first seat and said second seat.

3. The seat assembly described in claim 1, further comprising:

a pad removably secured to said first platform and a pad removably secured to said second platform;

a pad removably set onto the top surface of said first seat between said reclined state first back support structure and said first platform pad; and a pad removably set onto the top surface of said second seat between said reclined state second back support structure and said second platform pad.

4. The seat assembly described in claim 2, further comprising:

a pad removably set onto said at least one panel.

5. A seat assembly, said assembly comprising:

a first seat and a second seat;

a first back support structure secured to said first seat and a second back support structure secured to said second seat;

a first platform slidably mounted to the top surface of said first seat and a second platform slidably mounted to the top surface of said second seat;

said first and second back support structures having an upright state and a reclined state;

said first and second platforms sliding in a rectilinear direction fore and aft;

said first platform is slidably mounted to said first seat through a sliding mechanism;

said second platform is slidably mounted to said second seat through a sliding mechanism;

said first and second sliding mechanisms each comprising:

a pair of parallel tracks mounted to the top surface of the seat;

a pair of parallel tracks mounted to the bottom surface of the platform;

said seat tracks shaped to integrate with said platform tracks;

said platform tracks having a plurality of spaced horizontal holes;

a handle slidably mounted to said platform bottom surface between said pair of platform tracks;

said handle having a pair of elongated insertion pins;

said pins sized to insert into said platform track holes;

said pins being spring activated; and at least one panel removably set between said first seat and said second seat.

6. The seat assembly described in claim 5, further comprising:

a pad removably secured to said first platform and a pad removably secured to said second platform;

a pad removably set onto the top surface of said first seat between said reclined state first back support structure and said first platform pad; and a pad removably set onto the top surface of said second seat between said reclined state second back support structure and said second platform pad.

7. The seat assembly described in claim 5, further comprising:

a pad removably set onto said at least one panel.

8. A seat assembly, said assembly comprising:

a first seat and a second seat;

a first back support structure secured to said first seat and a second back support structure secured to said second seat;

a first platform slidably mounted to the top surface of said first seat and a second platform slidably mounted to the top surface of said second seat;

said first and second back support structures having an upright state and a reclined state;

said first and second platforms sliding in a rectilinear direction fore and aft;

said first platform is slidably mounted to said first seat through a sliding mechanism;

said second platform is slidably mounted to said second seat through a sliding mechanism;

said first and second sliding mechanisms each comprising:

a pair of parallel tracks mounted to the top surface of the seat;

a pair of parallel tracks mounted to the bottom surface of the platform;

said seat tracks shaped to integrate with said platform tracks;

said platform tracks having a plurality of spaced horizontal holes;

a handle slidably mounted to said platform bottom surface between said pair of platform tracks;

said handle having a pair of elongated insertion pins;

said pins sized to insert into said platform track holes; and at least one panel removably set between said first seat and said second seat;

a pad secured to said first seat back support structure and a pad secured to said second seat back support structure;

a pad removably secured to said first platform and a pad removably secured to said second platform;

a pad removably set onto the top surface of said first seat between said reclined state first back support structure and said first platform pad;

a pad removably set onto the top surface of said second seat between said reclined state second back support structure and said second platform pad; and a pad removably set onto said at least one panel.

* * * * *